US006084210A

United States Patent [19]

Glucksman

[11] Patent Number: 6,084,210

[45] Date of Patent: Jul. 4, 2000

[54] ROTATABLE HAIR CURLER SET WITH ELECTRIC HEATER

[75] Inventor: Dov Z. Glucksman, Wenham, Mass.

[73] Assignee: Windmere Corporation, Miami Lakes, Fla.

[21] Appl. No.: 09/411,923

[22] Filed: Oct. 4, 1999

[51] Int. Cl.[7] ..... A45D 4/16; A45D 4/18

[52] U.S. Cl. ..... 219/222; 219/388; 219/521; 219/541; 219/386; 132/229; 312/267; 211/164

[58] Field of Search ..... 219/222, 226, 219/388, 389, 521, 541, 385, 386; 132/227, 229, 237–238, 269; 221/120, 150 A, 277, 217; 432/124, 141; 312/266–269, 236; 211/164, 144, 131.2

[56] References Cited

U.S. PATENT DOCUMENTS

| | | | |
|---|---|---|---|
| 180,605 | 1/1876 | Lee . | |
| D. 215,258 | 9/1969 | Daher . | |
| D. 216,349 | 12/1969 | Bomeisler et al. . | |
| D. 218,869 | 9/1970 | Mercer . | |
| D. 221,116 | 7/1971 | Talge et al. . | |
| 250,908 | 12/1881 | Gordon . | |
| 253,290 | 2/1882 | Hunter | 312/266 |
| D. 264,637 | 5/1982 | Barradas . | |
| D. 286,126 | 10/1986 | Driscoll . | |
| D. 313,285 | 12/1990 | Montagnino et al. . | |
| D. 317,215 | 5/1991 | Montagnino et al. . | |
| D. 323,041 | 1/1992 | Montagnino et al. . | |
| D. 343,058 | 1/1994 | Allegre . | |
| D. 362,922 | 10/1995 | Prince et al. . | |
| D. 363,140 | 10/1995 | Accumanno et al. . | |
| D. 388,903 | 1/1998 | Kelsey . | |
| D. 392,414 | 3/1998 | Smal . | |
| D. 397,828 | 9/1998 | Kip . | |
| 412,544 | 10/1889 | Rood . | |
| 425,215 | 4/1890 | Franklin | 312/266 |
| 717,870 | 1/1903 | Landauer . | |
| 896,637 | 8/1908 | Herrman . | |
| 968,828 | 8/1910 | Beckley . | |
| 1,300,710 | 4/1919 | Edwards . | |
| 1,677,054 | 7/1928 | Shaw . | |
| 1,680,962 | 8/1928 | Voshardt . | |
| 1,970,128 | 8/1934 | Collins . | |
| 2,362,095 | 11/1944 | Ressinger . | |
| 2,517,420 | 8/1950 | Gauvreau . | |
| 2,525,274 | 10/1950 | Schleimer . | |
| 2,550,998 | 5/1951 | Hilliker . | |
| 2,646,891 | 7/1953 | Morgan | 312/266 |
| 2,661,114 | 12/1953 | Barnett et al. . | |
| 2,736,452 | 2/1956 | Roop . | |
| 2,927,545 | 3/1960 | Hieb | 99/443 |
| 3,159,441 | 12/1964 | Sikma | 312/267 |
| 3,283,122 | 11/1966 | McNair . | |
| 3,454,318 | 7/1969 | Kemp et al. . | |
| 3,473,005 | 10/1969 | Grandinetti . | |
| 3,495,583 | 2/1970 | Katzman et al. . | |
| 3,586,820 | 6/1971 | Yamanaka . | |
| 3,620,363 | 11/1971 | Donnithorne | 312/267 |
| 3,626,150 | 12/1971 | Kress . | |
| 3,654,428 | 4/1972 | Talge et al. . | |
| 3,665,840 | 5/1972 | Horany | 99/479 |
| 3,735,091 | 5/1973 | Baker . | |
| 3,889,097 | 6/1975 | Forsberg . | |
| 3,901,250 | 8/1975 | Tomiati . | |
| 4,298,787 | 11/1981 | Barradas . | |
| 4,317,461 | 3/1982 | Anderson . | |
| 4,334,629 | 6/1982 | Koch et al. . | |
| 4,382,447 | 5/1983 | Glucksman . | |
| 4,661,683 | 4/1987 | Glucksman . | |
| 4,680,444 | 7/1987 | Skovdal et al. . | |
| 4,685,479 | 8/1987 | McClean . | |
| 5,710,861 | 1/1998 | Stern . | |

*Primary Examiner*—John A. Jeffery
*Attorney, Agent, or Firm*—Barry E. Deutsch

[57] ABSTRACT

A hair curler set for heating a plurality of hair curling rollers includes an electric heater assembly. The set includes a housing having a rotatable shaft mounted therewithin. The longitudinal axis of the rotatable shaft is disposed substantially horizontally. The heater assembly comprises a generally circular disc and is mounted on the rotatable shaft at substantially the longitudinal mid-point thereof. A pair of mounting members are spaced at either end of the shaft. Each mounting member has a surface facing towards an opposed surface of the heater assembly. A plurality of rollers are mounted between the opposed surfaces of the mounting members and the heater assembly in a generally circular array.

14 Claims, 5 Drawing Sheets

23
22
32
34
14
54
28
16
26
46
38
36
12
20
18
10
24
48
30

ROTATABLE HAIR CURLER SET WITH ELECTRIC HEATER

BACKGROUND OF THE INVENTION

This invention relates to a hair curler set, and, in particular, to a hair curler set having a unique configuration that results in more effective heating for a plurality of hair curler rollers.

Conventional hair curler sets comprise a housing with a plurality of upstanding electrically heated posts. A number of rollers for curling the hair, usually of different diameters, are positioned on the posts to be heated to a required temperature. Rollers are usually cylindrically shaped and are provided with hair-gripping means on their circumference. The rollers also contain thermally-insulated portions to allow handling without the danger of burning the user's fingers.

Generally, hair curler sets of the prior art include relatively large rectangular housings which, in use, take up considerable countertop space. Further, the relatively large surface area presented by the housings of such prior art hair curler sets results in relatively large convective heat losses. The convective heat losses result in slower heat up of the rollers in the curler set and also less uniform heating of the rollers in the set.

Accordingly, it is an object of this invention to reduce the size of a hair curler set while decreasing the time in which the rollers reach a desired operating temperature. It is a further object of this invention more uniformly heat the rollers within a hair curler set.

SUMMARY OF THE INVENTION

The foregoing objects and other objects of the invention are attained in a hair curler set for heating a plurality of hair curling rollers by an electric heater assembly comprising a housing; a rotatable shaft mounted in the housing and having a longitudinal axis disposed substantially horizontally and extending generally parallel to one side of said housing; said heater assembly being mounted in said housing and electrically connected to a source of electric power; and a plurality of rollers mounted to the rotatable shaft for rotation therewith about the longitudinal axis of the shaft, each of said rollers being connected to said heater assembly.

In a preferred embodiment, the heater assembly is mounted on the rotatable shaft and is rotatable therewith. In the preferred embodiment, the heater assembly is mounted substantially at the longitudinal mid-point of the shaft.

Further, in the preferred embodiment two mounting members are longitudinally spaced at either end of the shaft. Each of the mounting members includes a surface facing towards an opposed surface of the heater assembly. The rollers extend longitudinally between opposed surfaces of one of the mounting members and the heater assembly.

The objects of the invention are further obtained in a method of heating a plurality of hair curling rollers comprising the steps of: inserting the rollers to be heated into a housing in a generally circular array distributed about the horizontal axis of the housing; connecting each of the rollers to a source of heat for heating each roller to a desired temperature level; and rotating the rollers about the horizontal axis to bring each roller to the apex of the circular array for enabling a user to selectively remove a roller from the housing.

DESCRIPTION OF THE PREFERRED EMBODIMENT

Figure 1:
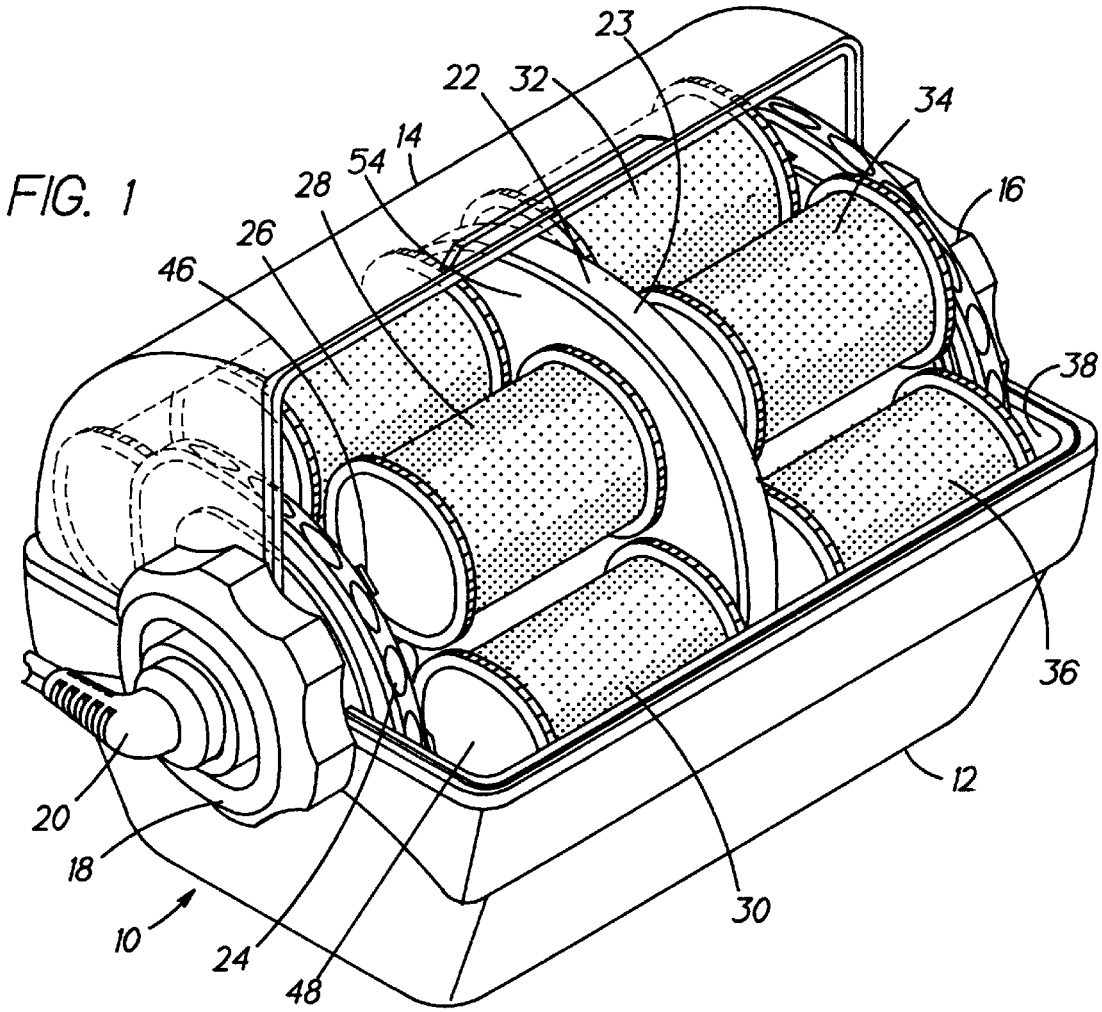
FIG. 1 is a perspective view taken from the front and left side of a hair curler set embodying the present invention.

Referring now to the figures of the drawing, there is disclosed a preferred embodiment of the present invention. In referring to the various figures of the drawing, like numerals shall refer to like parts.

The present invention is embodied in a hair curler set generally designated by reference numeral 10. Hair curler set 10 includes a generally rectangularly shaped base 12. Hair curler set 10 includes covers 14, 15. Cover 14 is movable relative to cover 15 and to base 12. In the position illustrated in FIG. 1, cover 14 is in its open position so that a user can gain access to interior 38 of base 12. When cover 14 is rotated in a clockwise direction, as viewed in FIG. 1, the outer edge of cover 14 mates with ledge 39 of base 12 to completely enclose interior area 38 of hair curler set 10.

Figure 2:
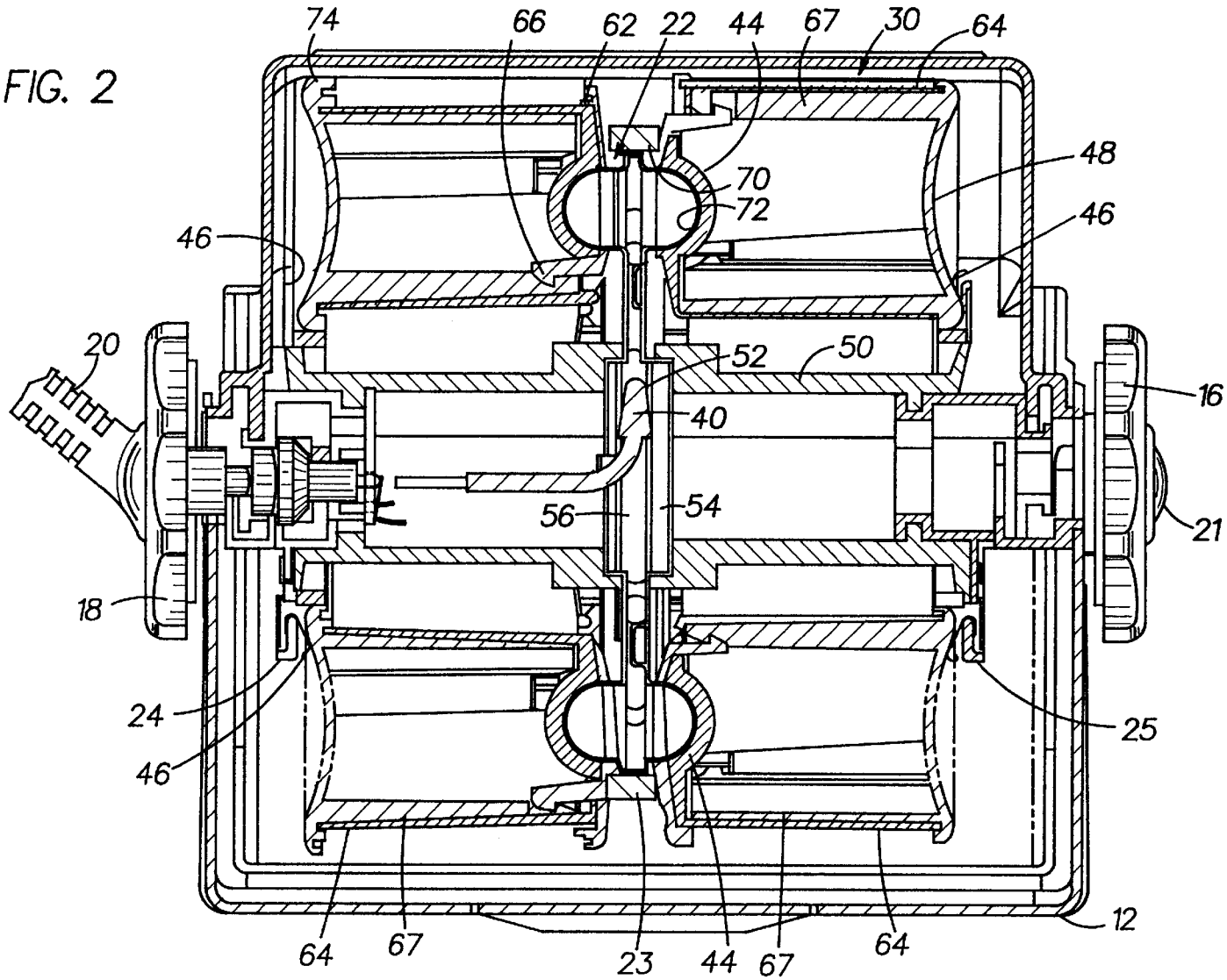
FIG. 2 is a longitudinal sectional view of the hair curler set illustrated in FIG. 1.

Hair curler set 10 further includes longitudinally spaced members 16, 18. Members 16, 18 are mounted on a shaft 50 (see FIG. 2) for rotation therewith. An indicator light 21 is positioned on the outer surface of member 16, and electrical power cord 20 extends through the center of member 18. A heater assembly 22 is mounted at substantially the longitudinal mid-point of shaft 50 for rotation therewith. A ring 23 circumferentially extends about the outer surface of heater assembly 22. Ring 23 is made from a suitable insulating material, such as plastic or the like.

Figure 3:
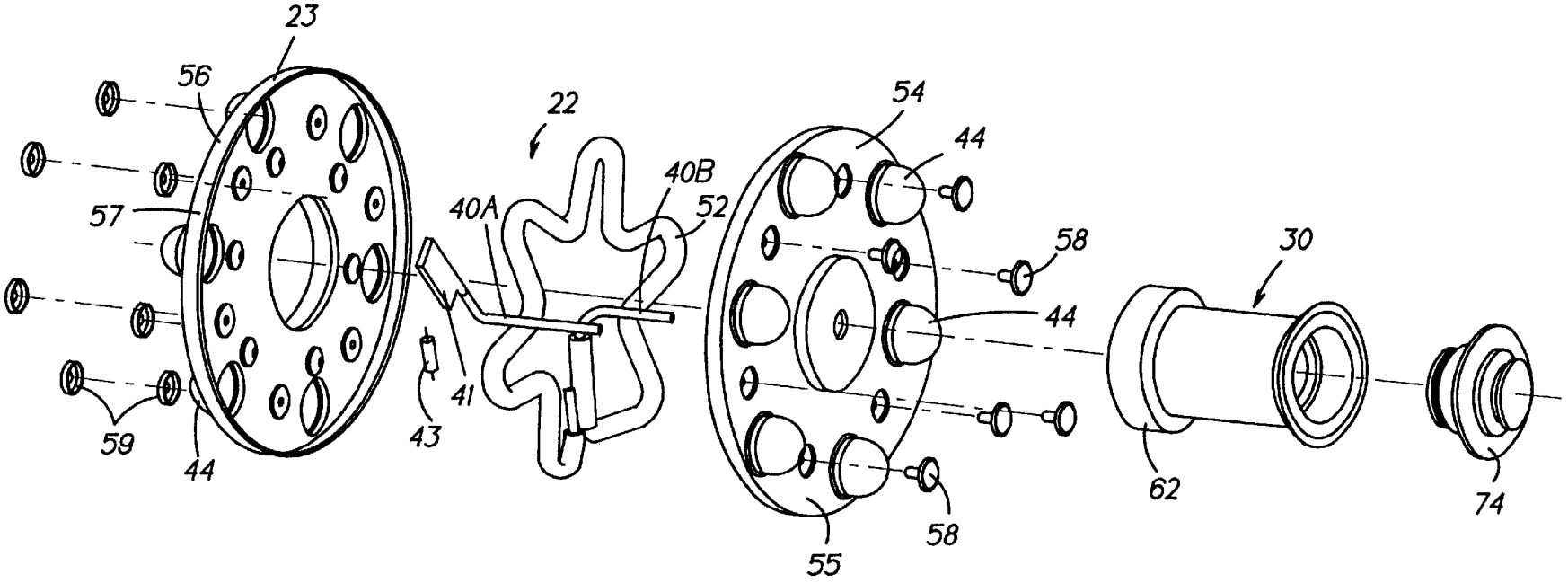
FIG. 3 is an exploded perspective view of a preferred embodiment of the resistance heater assembly employed in the hair curler set of the present invention.

As shown in FIG. 3, heater assembly 22 includes a pair of disc-like members 54, 56 which sandwich therebetween an electric resistance heater element 52. Disc 54 has an outer surface 55, and disc 56 has an outer surface 57. Discs 54, 56 and resistance element 52 are held together in assembled relationships via joining means 58, 59.

Surfaces 55, 57 of disc-like members 54, 56 include a plurality of dome-like projections 44 extending outwardly in a horizontal plane. The dome-like projections 44 and discs 54, 56 are preferably made from a material that has a relatively high coefficient of heat transfer, such as aluminum. Dome-like projections 44 are arranged in a circular pattern, having a diameter slightly smaller than the outer diameter of each heater disc 54, 56. The dome-like projections 44 in the outer surfaces 55, 57 of heater discs 54, 56 are heated as a consequence of the transfer of heat from electrical resistance heater 52 sandwiched between the two discs.

Figure 4:
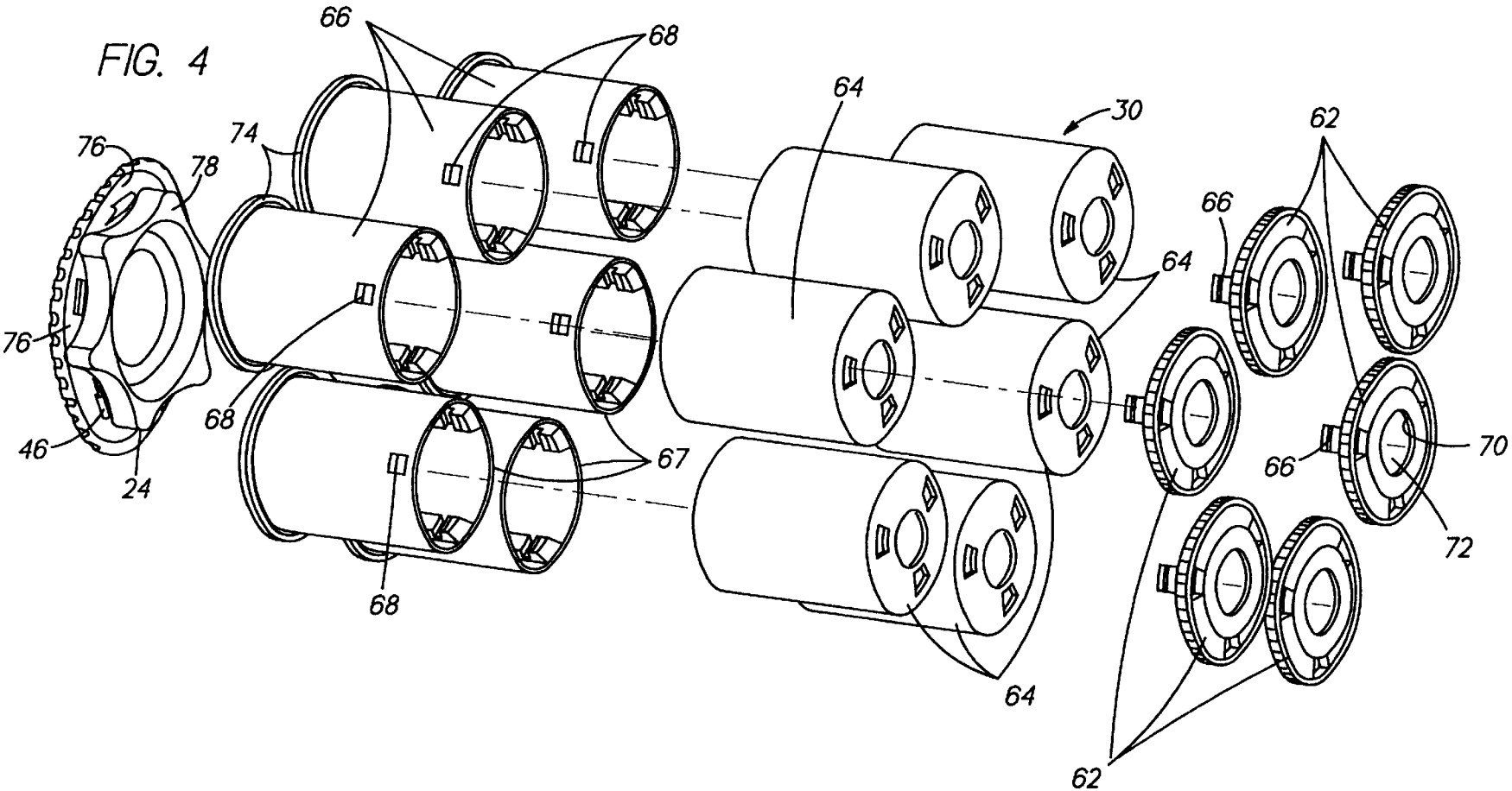
FIG. 4 is an exploded perspective view of the rollers used in the present invention.

Referring now to FIG. 4, there is disclosed a preferred embodiment of the rollers employed in the hair curler set of the present invention. The present hair curler set includes provision for heating twelve rollers simultaneously, although the set may be designed to accommodate a different number of rollers. Each of the rollers may be of the same diameter, or the rollers may comprise sets of rollers of two or more different diameters. In FIG. 4, each of the rollers comprises a pair of cylindrical members 64, 67. Cylindrical member 67 is telescopically received within cylindrical member 64. Preferably, member 67 is made from material that has a relatively low coefficient of heat transfer, such as polypropylene. Cylindrical member 64 is preferably made from a material having a relatively high coefficient of heat transfer, such as aluminum. Each cylindrical member 67 includes three openings or apertures 68 for a reason to be more fully described hereinafter. Each member 64 includes an end wall 71 having a depression 72 formed by concave surface 73.

Each roller also includes a pair of endcaps 62, 74. Endcap 74 may be made integral with cylindrical member 67 or may be made as a separate element. Each endcap 74 includes an outer surface 48. Endcap 74 is preferably formed from a material having a relatively low coefficient of heat transfer.

Each endcap 62 includes an opening 70. Opening 70 is axially aligned with depression 72. The shape of each depression 72 conforms with the shape of each dome-like projection 44 so that the dome-like projections can support one end of each roller. Since the shape of each projection 44 conforms with the shape of each depression 72, when the rollers are mounted on heater assembly 22, the transfer of heat from the heater assembly through the projections to the rollers is very effective. Each endcap 62 includes three hooked shaped spring clips 66. When cylindrical member 67 is placed within cylindrical member 64, endcap 62 is placed over the outer end of the assembly, and spring clips 66 are inserted into corresponding openings 68 of each inner cylindrical member 67 to hold the assembly together.

Hair curler set 10 further includes a pair of spaced disc-like members 24, 25 mounted about shaft 50. Each disc 24, 25 is mounted at an opposed end of the shaft. The surface of each disc 24, 25 facing towards heater assembly 22 includes a wall 78. Wall 78 separates the surface into a plurality of roller receiving segments 76. Each segment 76 includes a spring 46. Endcap 74 of each roller is placed into each segment 76. Springs 46 contact surfaces 48 of roller endcaps 74 to urge each roller inwardly towards resistance heater assembly 22. The foregoing results in a snug fit between dome-like projection 44 and depression 72 of each roller.

Figure 5:
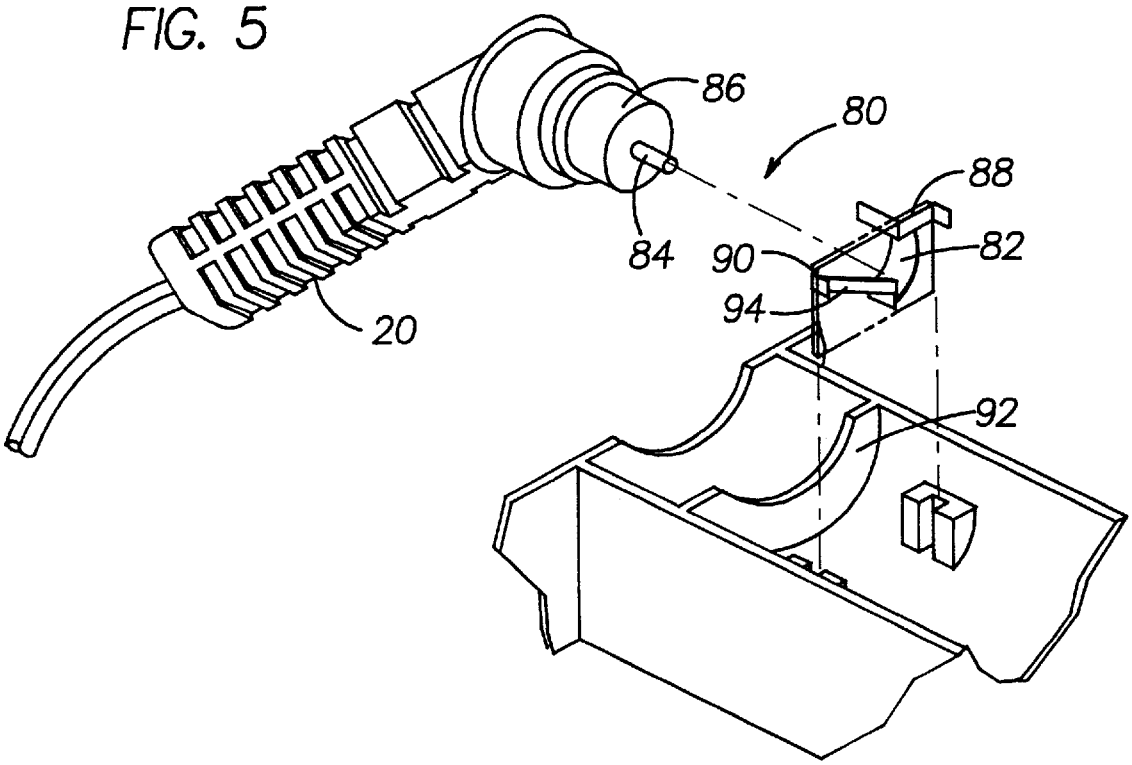
FIG. 5 is an exploded perspective view of a detail of the hair curler set illustrating the mechanism for maintaining electrical continuity during operation of the hair curler set of the present invention.
Figure 6:
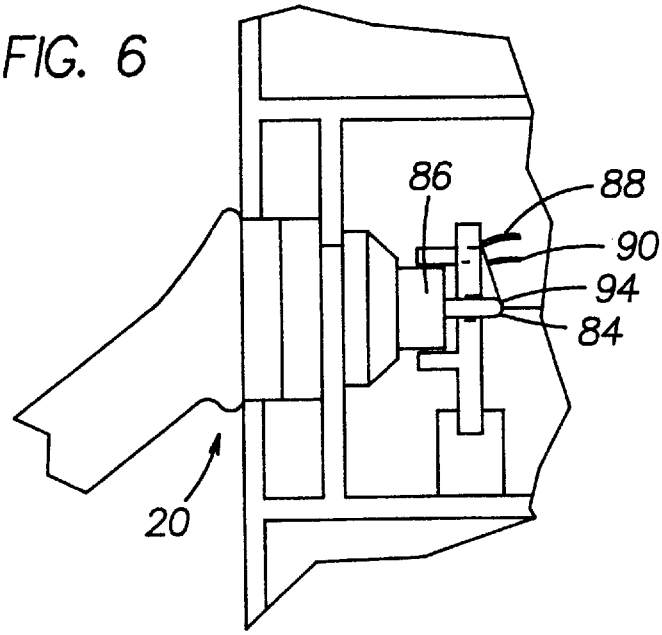
FIG. 6 is an elevational view illustrating the parts shown in FIG. 5 in assembled relationship.

Referring now to FIGS. 5 and 6, there is disclosed a preferred embodiment of the power supply used to provide electrical power to heater assembly 22. Power cord 20 terminates in electrical power conductor assembly 80. Power conductor assembly 80 is capable of transmitting electrical power to a rotating electrically powered device, such as heater assembly 22. Conductor assembly 80 includes a first cylindrical conductive element 84 and a second cylindrical conductive element 86. Element 86 circumferentially surrounds element 84. Conductor assembly 80 also includes a conductive arcuate member 82 which is connected to contact 88. Conductor 84 abuts against conductor 94 which in turn is in electrical communication with contact 90. Conductor 86 abuts against the surface of contact 82 which in turn is in electrically conductive relationship with contact 88. Contacts 88 and 90 deliver electrical power through conductor 40 to contacts 40A and 40B of electrical resistance heater element 52. A regulating thermostat 41 controls the temperature of heater element 52. A fuse 43 is electrically connected in series with heater element 52.

In operation, let us assume that a user desires to heat up the array of rollers (in the preferred embodiment 12 in number) of hair curler set 10. Electrical power is provided by power cord 20 through contacts 88, 90 to contacts 40A and 40B to provide electrical power to heater element 52 of heater assembly 22. To retain the heat within the enclosure, cover 14 is placed in its closed position relative to cover 15 and housing 12.

Dome-like projections 44 of heater assembly 22 are heated by element 52 and transfer heat through engagement with depressions 72 of the rollers to cylindrical members 64, 67. As indicated previously, member 67 is made from polypropylene which has a relatively low coefficient of heat transfer. Member 67 acts as a heat sink and actually provides heat to member 64 when a roller is placed in a user's hair. Member 67 extends the effective use of a roller. When the temperature of the rollers has reached a predetermined level, indicator light 21 is lit. Due to the compact nature of hair curler set 10, the desired temperature level is reached within a shorter time frame as compared to the time frame in which a standard curler set attains the same temperature level.

When the desired temperature level is reached, the user can remove one or more of the rollers by placing cover 14 in its open position. The user can rotate shaft 50 and the rollers mounted about the shaft through manipulation of discs 16, 18. A desired one roller can always be brought to the top of the circular array of rollers for removal of that one roller. Electrical power is supplied to the rollers remaining in set 10 even while the rollers are being rotated to the upper position in housing 12 for removal. Electrical continuity is maintained through the structure of conductors 84, 86, 82 and 94.

Although heater assembly 22 is shown as being rotatable, it is within the scope of the present invention for the heater to be maintained stationary while the rollers are rotated about a horizontal axis. If the heater assembly is maintained stationary, an intermediate member will be placed between the ends of the rollers adjacent the heater to enable the rollers to rotate relative to the stationary heater.

Testing has shown that not only will the rollers in the hair curler set of the present invention be heated to a desired temperature within a relatively shorter period of time when compared to heating rollers in a standard hair curler set to the same temperature, but the temperature differential between heated rollers in the hair curler set of the present invention will be smaller when compared to the temperature differential of heated rollers of a hair curler set of the prior art. The user of the rollers heated in hair curler set 10 should obtain more uniform curling results due to the reduced temperature differential from one roller to the next.

As illustrated in FIG. 1, Velcro® 35 or similar self-attaching material may be wrapped about the outer circumference of outer cylindrical member 64 of each roller for enabling the user to readily manipulate the hot rollers and for better attachment of the rollers within the user's hair.

While a preferred embodiment of the present invention has been described and illustrated, the invention should not be limited thereto, but may be otherwise embodied within the scope of the following claims.

What is claimed is:

1. A hair curler set for heating a plurality of hair curling rollers by an electric heater assembly comprising:

a housing;

a rotatable shaft mounted in the housing and having a longitudinal axis disposed substantially horizontally and extending generally parallel to one side of said housing;

said heater assembly being mounted in said housing and electrically connected to a source of electric power; and a plurality of rollers mounted on the rotatable shaft for rotation therewith about the longitudinal axis of the shaft, each of said rollers being heat conductively connected to said heater assembly.

2. A hair curler in accordance with claim 1 wherein said heater assembly comprises a heating member mounted on said rotatable shaft for rotation therewith.

3. A hair curler set in accordance with claim 2 wherein each of said rollers comprises a first member formed from a material having a relatively low coefficient of heat transfer; and a second member circumferentially surrounding the first member and formed from a material having a relatively high coefficient of heat transfer.

4. A hair curler set in accordance with claim 3 further including:

a mounting member positioned at one end of said shaft and including a surface facing towards the center of the shaft, at least one step being formed on said surface;

a spring mounted in said step for releasably holding one end of the roller in said step;

said heater assembly including a generally circular disc positioned substantially at the longitudinal mid-point of said shaft and having at least one protuberance longitudinally axially aligned with said at least one step, said protuberance contacting said second roller member of said roller for holding said roller between said step of said mounting member and said circular disc.

5. A hair curler set in accordance with claim 4 wherein said housing includes a cover having a first position forming a closed enclosure within the housing for said rotatable shaft, said heater assembly, and said plurality of rollers, said cover having a second position providing access to the enclosure to enable the user to selectively remove said rollers from said housing.

6. A method of heating a plurality of hair curling rollers comprising the steps of:

inserting the rollers to be heated into a housing in a generally circular array distributed about the horizontal axis of the housing;

connecting each of the rollers to a source of heat for heating each roller to a desired temperature level; and rotating the rollers about the horizontal axis to bring each roller to the apex of the circular array for enabling the user to selectively remove a roller from the housing.

7. A method of heating a plurality of hair curling rollers in accordance with claim 6 further including the step of rotating the source of heat about the horizontal axis while the rollers in the housing are connected to the source of heat.

8. A hair curler set for heating a plurality of hair curling rollers by an electrical heater assembly comprising:

a housing forming a generally U-shaped in cross section enclosure;

a movable cover connected to said housing and having a closed position for enclosing the housing enclosure;

a rotatable shaft mounted in the housing and having a longitudinal axis disposed substantially horizontally and extending generally parallel to one side of said housing;

a first mounting member position at one end of the shaft and a second mounting member position at the other end of said shaft, each of said mounting members including a surface facing towards the longitudinal mid-point of said shaft, each of said surfaces including a plurality of circumferentially spaced steps, each of said steps having a spring mounted thereto;

said heater assembly being mounted substantially at the longitudinal mid-point of said shaft for rotation therewith, said heater assembly having a first surface facing towards the surface of said first mounting member and a second surface facing towards the surface of said second mounting member, each of said surfaces of said heater assembly including a plurality of circumferentially spaced protuberances, each of said protuberances being longitudinally axially aligned with a corresponding step on said mounting members; and a plurality of rollers mounted about the rotatable shaft for rotation therewith about the longitudinal axis of said shaft, each of said rollers including a first end connected to one of the protuberances and a second end releasably held in said axially aligned step by said step spring.

9. A hair curler set in accordance with claim 8 wherein each of said rollers comprises a first member formed from a material having a relatively low coefficient of heat transfer; and a second member circumferentially surrounding the first member and formed from a material having a relatively high coefficient of heat transfer.

10. A hair curler set for heating a plurality of hair curling rollers by an electrical heater assembly comprising:

a housing;

a rotatable shaft mounted in the housing and having a longitudinal axis disposed substantially horizontally and extending generally parallel to one side of said housing;

said heater assembly being mounted in said housing and electrically connected to a source of electric power;

roller locating means mounted on said rotatable shaft for positioning a plurality of rollers in said housing in a circular array about the axis of said shaft; and said heater assembly including a plurality of spaced apart heat transfer elements positioned in a circular array about the axis of said shaft, each of said elements being in substantial longitudinal axial alignment with a different one of said rollers positioned by said roller locating means, each of said heat transfer elements being in heat transfer contact with a corresponding one of said rollers.

11. A hair curler set in accordance with claim 10 wherein each of said rollers includes a first end portion shaped to cooperate with said heat transfer elements to effect a large heat transfer contact area therebetween.

12. A hair curler set in accordance with claim 11 wherein said locating means comprises a pair of mounting members spaced from each other and positioned at either end of said shaft, and force producing means cooperating with said locating means and engaging a second end of each roller for urging the first end of each of said rollers into heat-conductive contact with said heat transfer elements of said heater assembly.

13. A hair curler set in accordance with claim 12 wherein said housing includes a cover having a first position forming a closed enclosure within the housing for said rotatable shaft, said heater assembly, and said plurality of rollers, said cover having a second position providing access to the enclosure to enable the user to selectively remove said rollers from said housing.

14. A hair curler set in accordance with claim 13 wherein said heater assembly includes a generally circular disc positioned substantially at the longitudinal mid-point of said shaft and each of said heat transfer elements comprises a protuberance longitudinally axially extending parallel to said rotatable shaft, each of said protuberances contacting a corresponding first end portion of a roller.

* * * * *